United States Patent [19]

Tomita et al.

[11] Patent Number: 4,563,690

[45] Date of Patent: Jan. 7, 1986

[54] THERMAL PRINTER

[75] Inventors: Hiroshi Tomita; Junji Maeda, both of Kyoto; Michio Kunimitsu, Yawata, all of Japan

[73] Assignee: Sanyo Electric Co., Ltd., Moriguchi, Japan

[21] Appl. No.: 716,379

[22] Filed: Mar. 26, 1985

[30] Foreign Application Priority Data

| | | | |
|---|---|---|---|
| Mar. 30, 1984 | [JP] | Japan | 59-64642 |
| Mar. 30, 1984 | [JP] | Japan | 59-47084[U] |
| Mar. 30, 1984 | [JP] | Japan | 59-47085[U] |
| Mar. 30, 1984 | [JP] | Japan | 59-47086[U] |

[51] Int. Cl.[4] ..... B41J 13/10

[52] U.S. Cl. ..... 346/76 PH; 346/134; 400/608.2; 271/9

[58] Field of Search ..... 346/76 PH, 76 R, 134; 250/317.1, 314; 400/120, 608.2; 271/9; 219/216 PH

[56] References Cited

U.S. PATENT DOCUMENTS

| | | | |
|---|---|---|---|
| 3,829,185 | 8/1974 | Lloyd | 242/55.53 |
| 4,107,700 | 8/1978 | Jornod | 346/76 PH |
| 4,216,719 | 8/1980 | Placeliere et al. | 400/608.2 |
| 4,521,785 | 6/1985 | Matsufuji | 346/134 |
| 4,522,519 | 6/1985 | DuBois | 271/9 |

*Primary Examiner*—E. A. Goldberg
*Assistant Examiner*—A. Evans
*Attorney, Agent, or Firm*—Wenderoth, Lind & Ponack

[57] ABSTRACT

A thermal printer of the present invention is basically constructed to use roll form printing paper, but able to use also fan-fold form printing paper by mounting to a casing; a guide shaft for fan-fold form printing paper instead of a roll for roll form printing paper; and a guide unit for fan-fold form printing paper, provided with side plates for regulating both side edges of fan-fold printing paper and with a press plate for restricting the upper surface of the same, and mounted to the casing in condition of being connected to an opening between the casing and the rear end of a cover for the casing.

The thermal printer of the present invention has a pair of reel plates to which the roll for roll form printing paper or the guide shaft for fan-fold form printing paper are mounted having larger diameter than the roll for roll form printing paper prior to use or guide shaft for fan-fold form printing paper, so that roll form or fan-fold form printing paper, when in use, is free from the skew, thereby enabling accurate and reliable paper feeding.

16 Claims, 11 Drawing Figures

THERMAL PRINTER

BACKGROUND OF THE INVENTION

1. Field of the Invention

This invention relates to a thermal printer selectively usable of printing paper in either fan-fold or roll form.

2. Description of the Prior Art

In the general thermal printer of a roll form printing paper using type, both ends of roll form paper are supported by two arm-like supports so that the roll form paper is transported between a drive roller and a press-contact roller. While, the same of a fan-fold form printing paper using type generally transports the printing paper by use of a feed roller with sprockets.

Accordingly, one printer usually is impossible to selectively use both the roll form and fan-fold form printing paper, which has been inconvenient.

The U.S. Pat. No. 3,829,185 has been proposed in order to eliminate such inconvenience, which discloses the provision of a sealed chamber for housing therein the fan-fold or roll form printing paper, means for tensioning the printing paper to be fed to an electrostatic head, and a broad leaf member positioned between the fan-fold form printing paper housed in the sealed chamber and the same stretched to be fed to the head and expanding transversely of the sealed chamber to the printing head, thereby preventing rubbing contact of fan-fold form printing paper housed in the sealed chamber with the same having been stretched.

The invention of the above patent, however, is constructed to house the fan-fold form printing paper always in the bottom of the printer, whereby it is deemed that the printer increases in the size as a whole and exchange of printing paper is not smooth.

OBJECT OF THE INVENTION

In the light of the above circumstances, this invention has been designed.

A first object of the invention is to provide a thermal printer selectively usable of both the roll form and fan-fold form printing papers.

A second object of the invention is to provide a thermal printer easy to exchange the printing paper to another of different form.

A third object of the invention is to provide a thermal printer easy to supply, exchange and mount consumption materials, such as the roll form printing paper, fan-fold form printing paper and ink sheet.

A fourth object of the invention is to provide a thermal printer which can reliably supply into the printer the fan-fold form printing paper placed at the exterior of the same.

A fifth object of the invention is to provide a thermal printer which, when the fan-fold form printing paper is supplied by guide means into the printer, restricts the printing paper in its movement in all the directions other than the supply direction, thereby enabling the fan-fold form printing paper to be supplied accurately and reliably to the printer.

A sixth object of the invention is to provide a thermal printer which includes roll form printing paper holding members each larger in an outer diameter than the roll form printing paper so as to supply into the printer the roll form printing paper while being regulated at both sides thereof, thereby enabling accurate and reliable supply of the printing paper to the printer.

The above and further objects and features of the invention will more fully be apparent from the following detailed description with accompanying drawings.

DETAILED DESCRIPTION OF THE INVENTION

Figure 1:
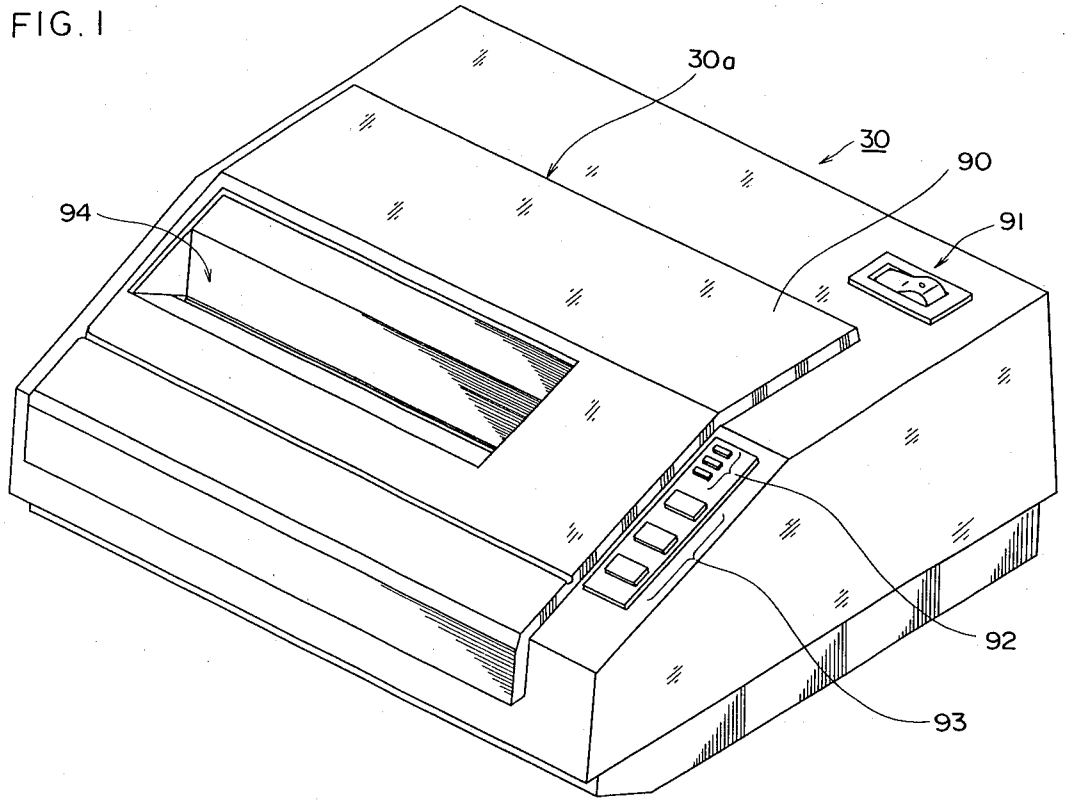
FIG. 1 is an exterior view of a thermal printer of the present invention when using roll form printing paper.

Referring to FIG. 1, a casing 30 is provided at the rearwardly right-hand side of the upper surface with a power switch 91 and at the right-hand side of the frontwardly downwardly slanted upper surface with an indicaters 92 and control switches 93, and a cover 90 providing in a range of not including these members an outlet 94 for the printing paper and an opening **30*a* for feeding fan-fold form printing paper into the printer of the invention, is attached to the casing 30**.

Figure 2:
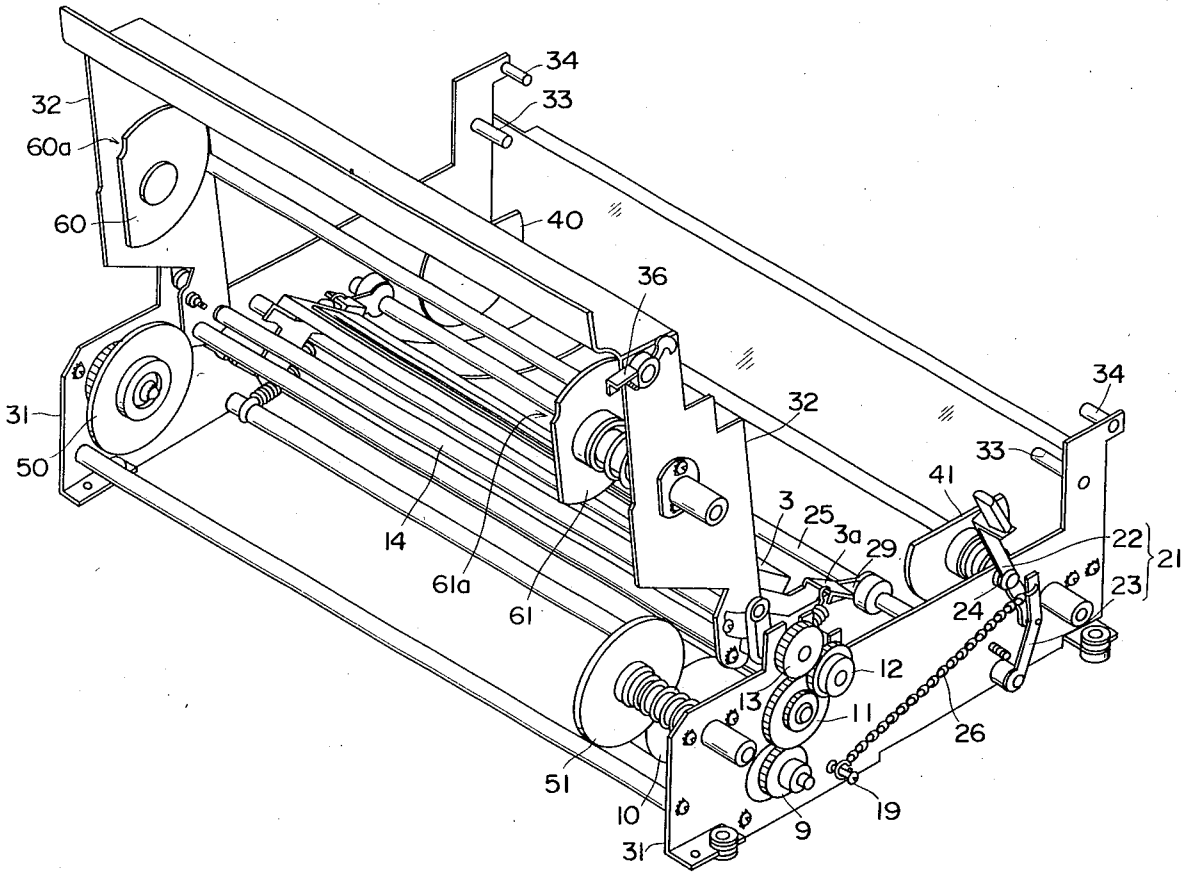
FIG. 2 is a typical view of the interior construction of the thermal printer of the present invention when charged with no printing paper thereto.
Figure 3:
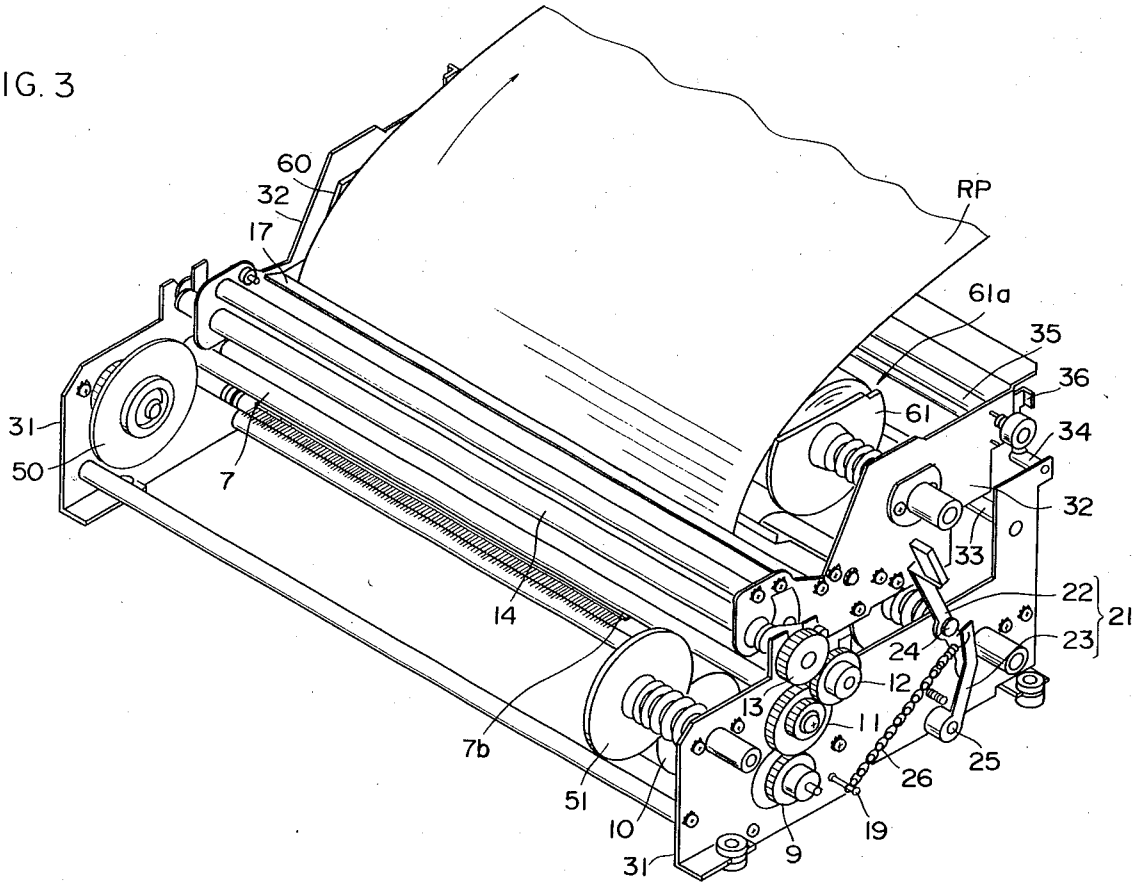
FIG. 3 is a typical view of the interior construction of the same when charged with the roll form printing paper thereto.
Figure 4:
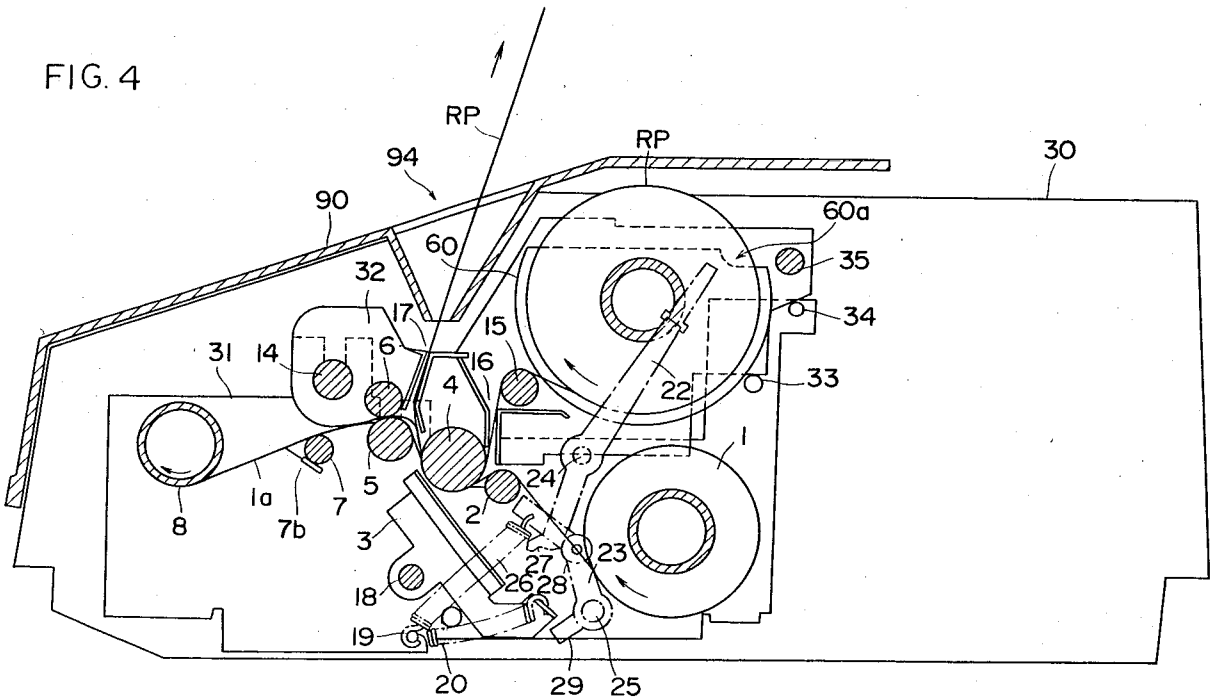
FIG. 4 is a sectional side view of the same.

At first, explanation will be given on the basic construction of the thermal printer of the invention and operation thereof when charged with roll form printing paper by reference to FIG. 2 showing the thermal printer of the invention prior to charge of printing paper thereto and FIGS. 3 and 4 showing the same when charged with roll form printing paper. In addition, the FIGS. 2 and 3 showing the interior construction only.

The casing 30 shown in FIGS. 2 and 3 includes at both transverse ends a pair of stationary side plates 31, 31 erect in parallel to each other longitudinally of the casing 30, the pair of stationary side plates 31, 31 supporting therebetween a first left- and right-hand reel plates 40 and 41 for putting therebetween an ink sheet roll 1, guide rods 2 and 7, rotary shafts of carrier roller 5, take-up roll 8 and thermal head 3, and a transmission shaft 14, the right-hand stationary side plate 31 supporting a motor 10, a transmission system (gears 11, 12 and transmission gear 13) for transmitting a rotary driving force from the motor 10, and a head release lever 21.

Figure 5:
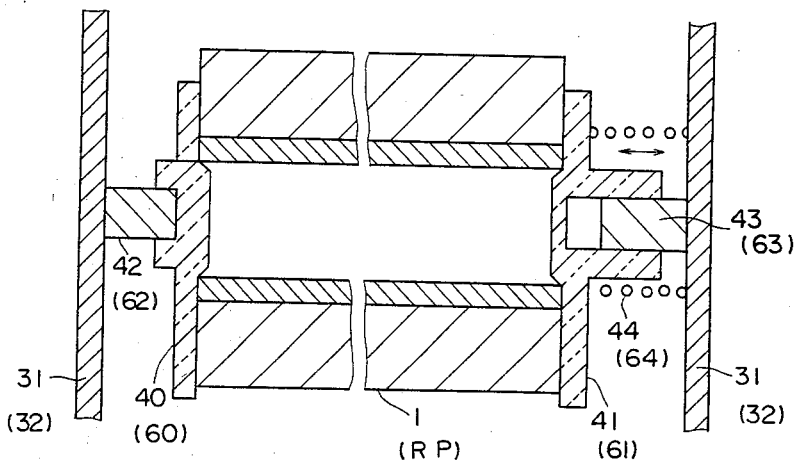
FIG. 5 is a typical view of construction for supporting reel plates sandwiching therebetween the roll form printing paper and those for supporting an ink sheet roll.

The ink sheet roll 1 has a hollow shaft for its easy exchange and is urged at both axial ends by the first left- and right-hand reel plates 40 and 41 as shown in FIG. 5, in which roll form printing paper to be discussed below is similarly urged at both ends by third left- and right-hand reel plates 60, 61 as shown by reference numerals parenthesized.

The first left- and right-hand reel plates 40 and 41 are mounted at the rear and lower portions at the inner surfaces of stationary side plates 31, 31, the left-hand reel plate 40 being fixed onto a spindle 42 projecting from the left-hand side plate 31. While, the right-hand reel plate 41 is mounted axially slidably onto a spindle 43 projecting from the right-hand side plate 31 and biased by a compression spring 44 toward the first left-hand reel plate 40 (toward the center of the printer).

Hence, the first right-hand reel plate 41 is moved rearwardly against the spring 44 to facilitate exchange of ink sheet roll 1.

The guide rod 2, carrier roller 5 and guide rod 7 are mounted on the stationary side plates 31, 31 forwardly in order from the first left- and right-hand reel plates 40 and 41 mounting positions, second left- and right-hand reel plates 50 and 51 for mounting the take-up roll 8 being mounted to the inner surfaces of stationary side plates 31, 31 frontward from the guide rod 7. In addition, an electrostatic eliminator brush **7*b* is fixed at the lower portion of guide rod 7 by screws, thereby eliminating static electricity at an ink sheet 1*a* just before wound onto the take-up roll 8**.

Figure 6:
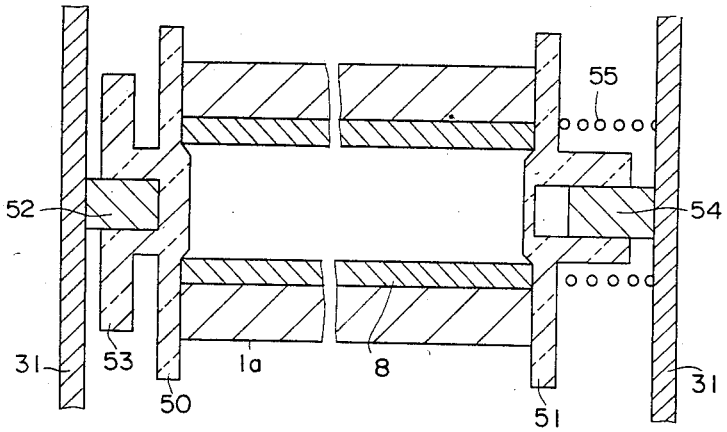
FIG. 6 is a typical view of support construction for reel plates sandwiching therebetween an ink sheet take-up roll.

Referring to FIG. 6, the take-up roll 8 for winding up the ink sheet **1*a* is put between the second left- and right-hand reel plates 50 and 51 mounted to the stationary side plates 31, 31 respectively, the take-up roll 8 being formed a hollow shaft as the same as the ink sheet roll shaft 1**.

The second left-hand reel plate 50 is unified with a pulley 53 mounted rotatably onto a spindle 52 projecting from the left-hand stationary side plate 31, the second right-hand reel plate 51 being mounted rotatably and axially slidably onto a spindle 54 projecting from the right-hand stationary side plate 31 and biased by a compression spring 55 toward the second left-hand reel plate 50 (toward the center of printer). Accordingly, the second right-hand reel plate 51 is moved rearwardly against the compression spring 55 to facilitate mounting of take-up roll 8 as the same as in the ink sheet roll 1.

At the frontward lower portion of the inner surface of right-hand stationary side plate 31 (substantially below the second right-hand reel plate 51) is mounted the motor 10 whose drive shaft perforates the right-hand stationary plate 31 and projects outwardly therefrom and fixedly supports a drive gear 9 at the projected end thereof, so that a driving force of motor 10 is transmitted through an idle gear 11 from the drive gear 9 to a gear 12 fixed to the projection of rotary shaft of carrier roller 5 projecting outwardly from the right-hand stationary side plate 31, thereby rotationally driving the carrier roller 5. The rotation of gear 12 is transmitted to the gear 13 to rotate the drive shaft 14 fixedly carrying the gear 13. Furthermore, a gear (not shown) is mounted to the carrier roller 5 at the side of left-hand stationary plate 31 thereof so as to rotary-drive the second left-hand reel plate 50. Hence, the take-up reel 8 put between the left- and right-hand reel plates 50 and 51 rotates.

Accordingly, when the ink sheet roll 1 is put between the first left- and right-hand reel plates 40 and 41 and front end of the ink sheet **1*a* is wound by the take-up roll 8, the motor 10 is driven to rotate the carrier roller 5 to thereby draw out the ink sheet 1*a* from the ink sheet roll 1 and wind up it onto the take-up roll 8**.

At the rearwardly upper portion at the inner surface of both the stationary side plates 31, 31 are provided lock pins 34, 34 and at the somewhat frontward lower portion at the same are provided stop pins 33, 33, the lock pins 34, 34 and stop pins 33, 33 projecting inwardly respectively.

Now, a pair of movable side plates 32, 32 are supported at the fore ends thereof rotatably to the transmission shaft 14 at both end portions somewhat inward from both the side plates 31, 31.

FIG. 2 shows the thermal printer of the present invention in condition of turning both the movable side plates 32, 32 at the rear end thereof upwardly forwardly around the transmission shaft 14. A shaft 35 is inserted rotatably into the rear ends of movable side plates 32, 32 and lock levers 36, 36 are fixed at both ends of shaft 35 projecting outwardly from the movable side plates 32, 32 respectively.

Hence, both the movable side plates 32, 32, when turned rearwardly downwardly at the rear ends thereof as shown in FIGS. 3 and 4, abut at the rear ends against stop pins 33, 33 to be restricted in turning and fixed in this condition by engaging lock levers 36, 36 with the lock pins 34, 34 respectively.

Now, the movable side plates 32, 32 support a press-contact roller 6 and a platen 4 therebetween, in a case where the movable side plates 32, 32 are locked to the stationary side plates 31, 31 respectively, the press-contact roller 6 is positioned to abut against the carrier roller 5 and also the platen 4 is provided between the guide rod 2 and the thermal head 3. The movable side plates 32, 32 carry at the upwardly rearward portions third left- and right-hand reel plates 60 and 61. In addition, the third left- and right-hand reel plates 60 and 61 are mounted to the movable side plates 32, 32 as the same as the first left- and right-hand reel plates 40 and 41 to the stationary side plates 31, 31, which are shown in FIG. 5 by parenthesizing the corresponding reference numerals. In this case, the third right-reel plate 61 is moved rearwardly against a spring 64 to facilitate charging or discharging of the roll form printing paper as the same as the first right-hand reel plate 41.

Here, diameters of the third left- and right-hand reel plates 60 and 61 are larger by about 2 to 5 mm than the maximum outer diameter of roll form printing paper RP (in other words, an outer diameter thereof when not yet used), whereby the third left- and right-hand reel plates 60 and 61 serve as guide plates for both ends of roll form printing paper RP to prevent it from moving obliquely.

Figure 8:
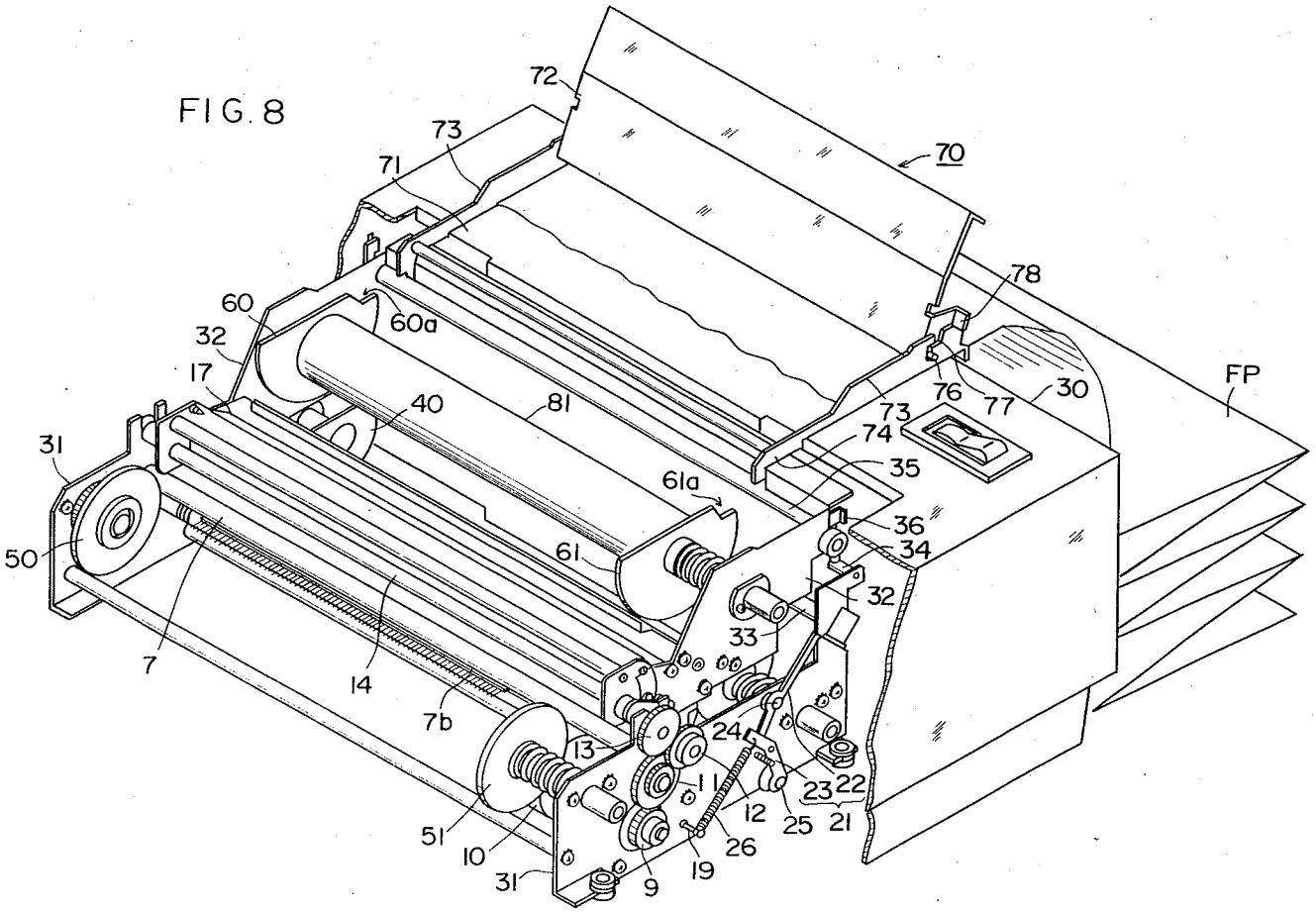
FIG. 8 is a partially cutaway view of the interior construction of the thermal printer of the present invention charged with fan-fold form printing paper.
Figure 9:
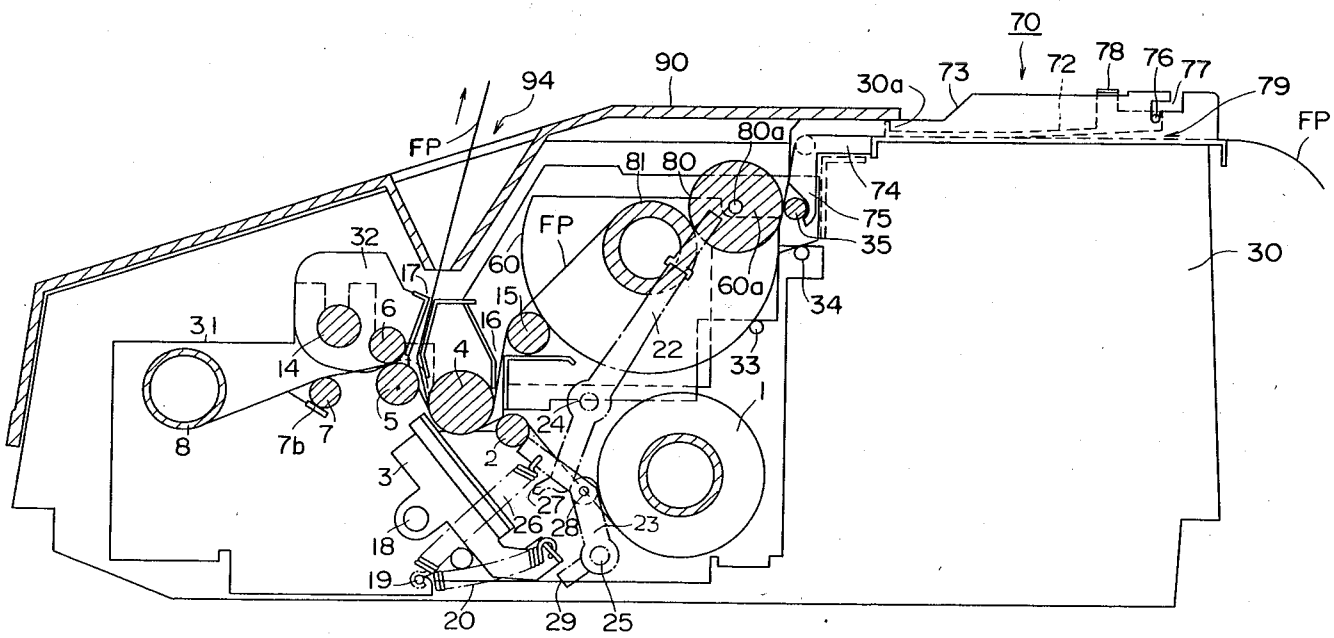
FIG. 9 is a typical sectional side view of the same.

In this embodiment, the third left- and right-hand reel plates 60 and 61 also are cut at the upper portion by about one quarter and at the rear portions of the cuts are provided cutouts **60*a* and 61*a*, which are used to mount thereon a first guide shaft 80*a* (refer to FIGS. 8 and 9**) used for fan-fold form printing paper FP to be discussed below.

Also, when the left- and right-hand movable side plates 32, 32 are turned at the rear ends thereof upwardly around the transmission shaft 14, the ink sheet roll 1 is exposed, thereby being very easy to exchange.

The thermal head 3 is mounted at its rotary shaft 18 to both the stationary side plates 31, 31 below about the center between the guide rod 2 and the carrier roller 5, which is required to be in press-contact lightly with the platen 4 during the normal operation, whereby a spring 20 tensioned between a shaft 19 below the rotary shaft 18 and the lower end 3*a* of thermal head 3 biases the thermal head 3 to turn clockwise (in the direction of moving the upper portion thereof rearwardly) in FIG. 4.

Also, the thermal head 3 is constructed to move away from the platen 4 through the head release lever 21. In detail, the head release lever 21 comprises a first lever 22 and second lever 23. The first lever 22 is pivoted at its about central portion to a shaft 24 which is pivoted at the right-hand stationary side plate 31 rearwardly upwardly of the rotary shaft 18 of thermal head 3 and projecting outwardly from the side plate 31. The second lever 23 is fixed at the lower end thereof to a shaft 25 rotatably positioning outwardly from the right-hand stationary side plate 31 and positioned below the rotary shaft 24 for the first lever 22. The first lever 22 is formed at the lower end thereof a hook 27. The second lever 23 is bent somewhat forwardly at its substantially central portion of the upper portion extending from the rotary shaft 25, so that the bent portion providing a press-contact roller 28 against which the hook 27 at the first lever 22 is adapted to abut. Furthermore, to the rotary shaft 25, on which the second lever 23 is fixed, is mounted a push pawl 29 for biasing upwardly the lower end 3*a* of thermal head 3 from below when the rotary shaft 25 rotates clockwise. Also, a spring 26 is tensioned between the upper end of the second lever 23 and the shaft 19, so that the second lever 23 is biased to turn counterclockwise around the shaft 19.

Accordingly, when the first lever 22 is turned counterclockwise, the hook 27 abuts against the roller 28, and when the same is further turned counterclockwise, the second lever 23 turns clockwise around the shaft 25 and together therewith against the tensile strength of the spring 26. Hence, the push pawl 29 abuts against the lower end 3*a* of thermal head 3 and pushes upwardly the lower end 3*a*, whereby the thermal head 3 turns counterclockwise around the shaft 18 against tensile strength of spring 20 and moves away from the platen 4, at which time the press-contact roller 28 describes a circle clockwise with rotation of the first lever 22. The hook 27 at the first lever 22, when the roller 28 is intended to return beyond the highest point of the circular path of roll 28 after it has moved beyond the same, pushes the press-contact roll 28 from above, thereby restraining the roller 28 from the above movement to hold the first and second levers 22 and 23 at the position beyond the highest point (refer to FIGS. 2 and 3). In other words, the head release lever 21 has the stable point in the state where the thermal head 3 abuts against the platen 4 or moves away therefrom.

Next, explanation will be given on operation of the thermal printer of the present invention when using the roll form printing paper RP.

At first, the pair of movable side plates 32, 32, as shown in FIG. 2, are turned upwardly, the ink sheet roll 1 is interposed between the first left- and right-hand reel plates 40 and 41, and the take-up roll 8 (it is convenient to use sequentially the core of ink sheet roll 1 after used) is interposed between the second left- and right-hand reel plates 50 and 51. Thereafter, the ink sheet 1*a* is drawn out at its end from the ink sheet roll 1 and then wound onto the take-up roll 8 via each the upper surface of the guide rod 2, carrier roll 5, and guide rod 7. Next, both the movable side plates 32, 32 are turned rearwardly and the lock levers 36, 36 are locked in engagement with the lock pins 34, 34 respectively. Thereafter, the roll form printing paper RP is interposed between the third left- and right-hand reel plates 60 and 61, the head release lever 21 is manually operated to move the thermal head 3 away from the platen 4, the roll form printing paper RP interposed between the third left- and right-hand plates 60 and 61 is inserted at the end into an inlet 16 through the upper surface of the guide roll 15 and then between the thermal head 3 and the platen 4, and, when further inserted, is discharged at the front end from an outlet 17. In such condition, the head release lever 21 is manually reoperated to allow the thermal head 3 to abut against the platen 4, thereby enabling thermal printing by the thermal head 3 onto the roll form printing paper RP.

The actual thermal printing is carried out as follows: The rotation of drive gear 9 by the motor 10 is transmitted to the gear 12 through the transmission gear 11, thereby rotary-driving the carrier gear 5 to which the gear 12 is fixed. The take-up roll 8 is hollow and held at both axial ends by the second left- and right-hand reel plates 50 and 51, so that the driving force is transmitted from the motor 10 to the second left-hand reel plate 50 through the transmission gear 13, transmission shaft 14 and a gear (not shown), to thereby rotate the take-up roll 8. Hence, the motor 10 is driven to rotate the carrier roller 5 to thereby draw out the ink sheet 1*a* from the ink sheet roll 1, the ink sheet 1*a* drawn out therefrom passes between the thermal head 3 and the rotatable platen 4 abutting thereagainst through the guide rod 2 and further between the carrier roller 5 and the contact roller 6 abutting thereagainst, and through the guide rod 7, and is eliminated of static electricity by the electrostatic eliminator brush 7*b*, and thereafter is wound onto the take-up roll 8.

The roll form printing paper RP is guided via the upper surface of the guide rod 15 and inlet 16 between the thermal head 3 and the platen 4 and transported therebetween together with the ink sheet 1*a* by means of friction therewith and then discharged from the outlet 17. The thermal head 3, which is biased by the spring 20 to abut against the platen 4, transfers and prints the ink from the ink sheet 1*a* between the thermal head 3 and the platen 4 onto the roll form printing paper RP in accordance with the heating pattern of thermal head 3.

Figure 7:
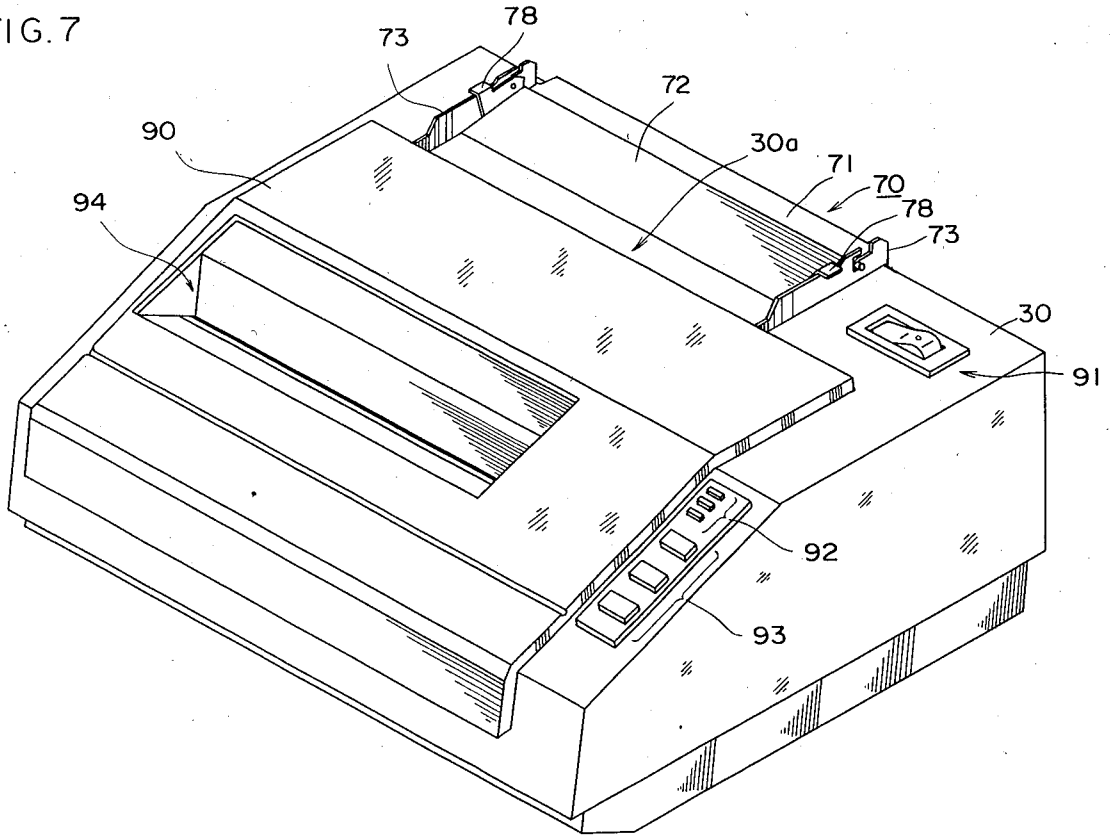
FIG. 7 is an exterior view of the thermal printer of the present invention, to which fan-fold form printing paper guiding unit is mounted.

Referring to FIG. 7, at the rearwardly upper surface of casing 30 is mounted a guide unit 70 for fan-fold form printing paper FP. Next, explanation will be given on construction and operation of the thermal printer of the invention when using the fan-fold form printing paper in accordance with FIGS. 8 and 9.

When the fan-fold form printing paper is used, besides the fundamental construction for the use of roll form printing paper RP, the guide unit 70 is mounted at the rearwardly upper surface of casing 30 as above-mentioned, a first guide shaft 80 is placed at both axial ends on the cutouts 60*a* and 61*a* at the third left- and right-hand side plates 60 and 61, and a second cylindrical guide shaft 81 (practical when a core of used roll form printing paper RP is used therefor) is mounted between the third left- and right-hand reel plates 60 and 61.

The guide unit 70 mainly comprises a main plate 71 placed directly on the rearwardly upper portion of casing 30 and serves as a substrate, side plates 73, 73 erect at both sides of main plate 71 (at both sides in the paper feed direction), and a press plate 72 pivoted at the rear end thereof to both the side plates 73, 73 at the rearward portion thereof in relation being vertically swingable.

The side plates 73, 73 project at the forward portions forwardly beyond the front edge of main plate 71 and bend downwardly, thereby being L-like-shaped to form arms 74, 74 respectively, the arms 74, 74 each being cut out at the utmost end and curved rearwardly to form a hook 75. In addition, the hooks 75, 75 are adapted to abut just against the aforesaid shaft 35 respectively when the guide unit 70 is mounted on the rearwardly upper surface of the casing 30. At the rear portion of each side plate 73 is provided a cutout 77 of about Z-like shape. At both sides of rear end portion of press plate 72 are provided projections 76, 76 extending leftwardly and rightwardly from the press plate 72 respectively, and at the portions somewhat forward from the projections 76, 76 are provided upright retainers 78, 78 of channel-like shape in section, which extend at the upper end outwardly beyond the upper end of the side plates 73 respectively.

Figure 10:
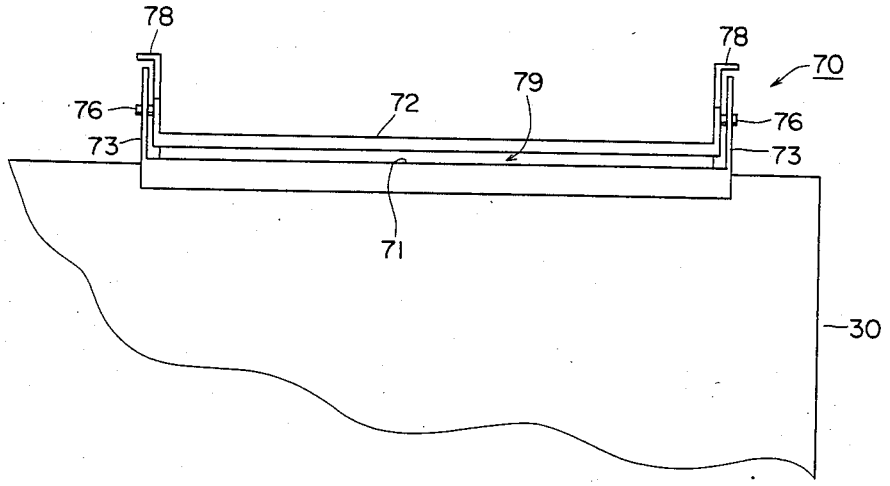
FIG. 10 is a rear view of the fan-fold form printing paper guiding unit when in use.
Figure 11:
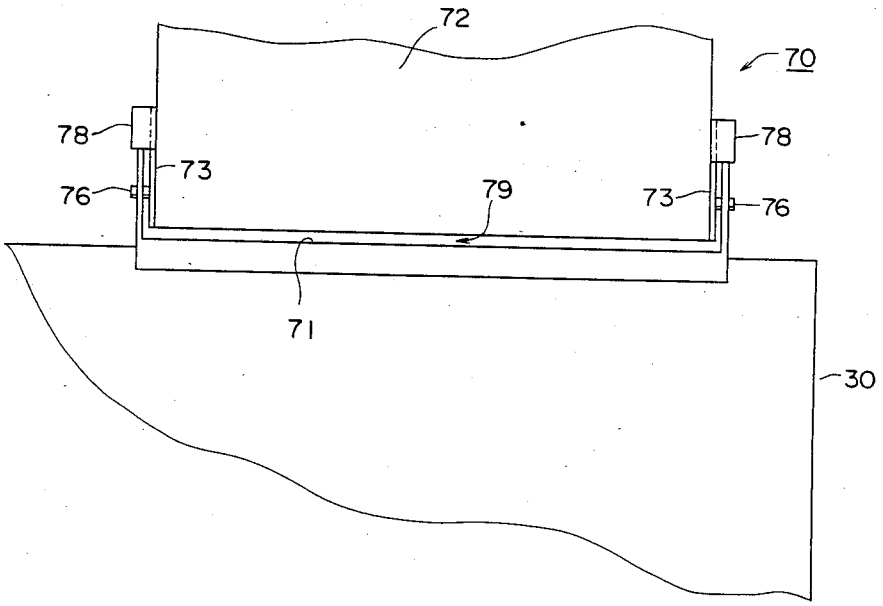
FIG. 11 is a typical view of the same when fan-fold form printing paper is charged therein.

The projections 76, 76 and cutouts 77, 77 are positioned in the relation that, as shown in the rear views of FIG. 10 in which the press plate 72 is turned forwardly to abut at the front end against the main plate 71 when in usual use, and of FIG. 11 in which the same is upright, a gap 79 of several millimeters in vertical length is formed between the rear ends of main plate 71 and pressure plate 72, so that the fan-fold form printing paper FP is inserted therebetween through the gap 79. The pressure plate 72 swingable around the projections 76, 76, when turned rearwardly upwardly, is restricted in further turn by abutting of retainers 78, 78 against the upper edges at the rear ends of side plates 73, 73 respectively and can be kept upright state.

Now, in a case where the guide unit 70 is mounted in predetermined position and the cover 90 is attached to the printer of the invention, the rear end of cover 90 is placed on the front ends of both the side plates 73, 73 to form an opening 30*a* enclosed with the lower side of the rear end of the cover 90, inside surfaces of side plates 73, 73 and the upper surface of the main plate 71. Since the press plate 72 is inserted at its foremost end into the opening 30*a*, the fan-fold form printing paper FP is inserted between the main plate 71 and the press plate 72 through the opening 79 and then charged into the casing 30 through the opening 30*a*.

Next, explanation will be given on operation of the thermal printer of the invention when the fan-fold form printing paper FP is used therefor.

Firstly, in the state where the cover 90 is removed, the utmost end of L-like-shaped arm 74 at each side plate 73, 73 while keeping the main plate 71 upright, abuts at both the hooks 75, 75 against the shaft 35 appearing from the opening 30*a* so that the main plate 71 is rotated clockwise to thereby set the guide unit 70 in condition of placing the main plate 71 on the rearwardly upper surface of casing 30.

The fan-fold form printing paper, while keeping the press plate 72 upright, is inserted between the main plate 71 and the press plate 72 through the gap 79 therebetween, and then the press plate 72 is turned counterclockwise so that its utmost end brings the fan-fold form printing paper FP into press-contact with the main plate 71, thereby preventing the fan-fold form printing paper FP from obliquely moving and also from upwardly bending, thus being guided forwardly.

The fan-fold form printing paper FP thus guided is inserted into the inlet 16 via each upper surface of second guide shaft 81 and a guide roll 15, passes between the thermal head 3 and the platen 4 abutting therea-against, and then is discharged from the outlet 17. Incidentally, when the fan-fold form printing paper FP is inserted as the above, the head release lever 21 is controlled to once move the thermal head 3 away from the platen 4 as the same as when the roll form printing paper RP is set.

Next, the first guide shaft 80 is mounted onto the third left- and right-hand reel plates 60 and 61 in condition of resting the projections 80*a* of both axial ends of guide shaft 80 on the cutouts 60*a* and 61*a* provided at the rearwardly upper portion respectively. In addition, the first guide shaft 80 employs a rod material, such as plastic or aluminum, of relatively low friction coefficient. Thereafter, the cover 90 is attached to the casing 30 at the predetermined position.

Thus, the fan-fold form printing paper FP is adapted to be guided by the guide unit 70 so as to enter into the casing 30, guided downwardly toward the first guide shaft 80, transported upwardly along the lower half surface thereof and then again downwardly along the upper half surface of second guide shaft 81, and thereafter transported toward the lower guide roll 15. In this case, the fan-fold form printing paper FP is transported while being reliably guided at both ends by the third left- and right-hand reel plates 60 and 61, and changed zigzag in the forward direction so that an apparent rigidity of the fan-fold form printing paper FP increases to eliminate a fear of the skew.

Alternatively, instead of the cutouts 60*a* and 61*a*, a bore into which one projection 80*a* of first guide shaft 80 is to be inserted may be provided at one of third reel plate 60 and 61 and the first guide shaft 80 may be inserted at both axial ends into the bore of one of reel plates 60 and 61 and rest on the cutout at the other.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. A thermal printer characterized by providing:

a casing;

an opening formed in said casing for feeding therethrough fan-fold form printing paper into said casing;

a pair of left- and right-hand reel plates disposed in said casing and for supporting therebetween a roll around which roll form printing paper is wound;

a guide shaft for the fan-fold form printing paper, which is detachably mounted to said pair of left- and right-hand reel plates;

a platen;

a thermal head which is disposed opposite to said platen and capable of contacting with or moving away from said platen;

means for supporting a roll around which an ink sheet is wound; and an ink sheet transportation mechanism which transports said ink sheet passing between said platen and said thermal head opposite to each other;

whereby when said roll having printing paper wound thereon is mounted between said pair of left- and right-hand reel plates, roll form printing paper is drawn out from said roll, and when said guide shaft for fan-fold form printing paper is mounted between said pair of left- and right-hand reel plates, fan-fold form printing paper can be inserted into said casing from the exterior thereof through said opening and brought into slidable contact with the periphery of said guide shaft, and thereafter the particular form of printing paper being supplied is transported and passed between said platen and said thermal head to be printed with the ink of said ink sheet.

2. A thermal printer as set forth in claim 1, wherein said casing is provided at the upper surface thereof with a cover detachably mounted thereto.

3. A thermal printer as set forth in claim 2, wherein said opening for feeding therethrough fan-fold form printing paper is formed between the upper surface of said casing and the lower surface of the rear end of said cover in the paper feed direction.

4. A thermal printer as set forth in claim 1, wherein a guide unit is provided for inserting fan-fold form printing paper into said opening for feeding therethrough fan-fold form printing paper.

5. A thermal printer as set forth in claim 4, wherein said guide unit is detachably mounted onto said casing.

6. A thermal printer as set forth in claim 4, wherein said guide unit is provided with a pair of side plates for regulating both sides of fan-fold form printing paper to be inserted into said opening, and a pressing plate for restricting the upper surface of fan-fold printing paper.

7. A thermal printer as set forth in claim 6, wherein said guide unit is detachably mounted onto said casing.

8. A thermal printer as set forth in claim 6, wherein said pressing plate is pivoted at both axial ends of a rotary shaft thereof perpendicular to the paper feeding direction to the pair of said side plates respectively.

9. A thermal printer as set forth in claim 3, wherein said guide unit is provided with:

a pair of L-shaped arms each having at the free end a hook engageable with a shaft disposed in said casing and extending perpendicularly to the paper feeding direction;

a bottom plate having, at both sides of fed fan-fold form printing paper, side plates unified with said L-shaped arms respectively; and a pressing plate supported at both sides thereof at the rear side in the paper feeding direction rotatably to both said side plates respectively.

10. A thermal printer as set forth in claim 9, wherein said guide unit is detachably mounted onto said casing.

11. A thermal printer as set forth in claim 1, wherein said pair of reel plates are provided above said ink sheet roll support means.

12. A thermal printer as set forth in claim 1, wherein said pair of reel plates each have a substantial diameter larger than the outer diameter of roll form printing paper prior to the use.

13. A thermal printer as set forth in claim 1, wherein said pair of reel plates each have a substantial diameter larger than the diameter of said guide shaft for fan-fold form printing paper.

14. A thermal printer as set forth in claim 1, wherein between the upper portions of said pair of reel plates at said opening side is detachably mounted another guide shaft for guiding fan-fold printing paper to be brought into slidable contact with the lower peripheral surface thereof.

15. A thermal printer as set forth in claim 14, wherein at least one of said pair of reel plates is provided at the upper portion at said opening side with a cutout to which said another guide shaft is to be detachably mounted.

16. A thermal printer as set forth in claim 1, wherein roll form or fan-fold form printing paper is adapted to be transported by a frictional force of said ink sheet transported by said ink sheet transportation mechanism.

* * * * *